US005542721A

United States Patent [19]

Allen

[11] Patent Number: 5,542,721

[45] Date of Patent: Aug. 6, 1996

[54] VENTILATION STOP FOR A SLIDING WINDOW OR DOOR

[75] Inventor: Gregory B. Allen, Rochester, N.Y.

[73] Assignee: Pace Window & Door Corp., Victor, N.Y.

[21] Appl. No.: 386,564

[22] Filed: Feb. 10, 1995

[51] Int. Cl.[6] ..... E05C 3/02

[52] U.S. Cl. ..... 292/194; 292/DIG. 9; 292/DIG. 46; 292/DIG. 47; 16/337; 16/342

[58] Field of Search ..... 292/194, 338, 292/339, 44, 300, DIG. 20, DIG. 46, DIG. 47, DIG. 9

[56] References Cited

U.S. PATENT DOCUMENTS

| | | | |
|---|---|---|---|
| 391,119 | 10/1888 | Chisholm | 292/194 X |
| 614,741 | 11/1898 | Moore, Jr. | 292/339 X |
| 916,446 | 3/1909 | Hunt | 292/DIG. 9 X |
| 1,995,772 | 3/1935 | Jacobs | 16/342 X |
| 2,356,427 | 8/1944 | Pressnall | 292/DIG. 9 X |
| 2,504,351 | 4/1950 | Ring | 16/342 |
| 2,941,832 | 6/1960 | Grossman | 292/DIG. 46 X |
| 3,363,363 | 1/1968 | Beasley, Jr. | 49/407 |
| 3,728,820 | 4/1973 | Lange | 49/346 |
| 3,837,693 | 9/1974 | Adickes | 292/DIG. 20 X |
| 4,061,372 | 12/1977 | Cardoso | 292/DIG. 46 X |
| 4,103,947 | 8/1978 | Delaney | 292/194 |
| 4,144,674 | 3/1979 | Dovman | 49/417 |
| 4,222,596 | 9/1980 | Delaney | 292/342 |
| 4,736,974 | 4/1988 | Rosenthal | 292/DIG. 47 X |
| 4,758,033 | 7/1988 | Wolf | 292/305 |
| 4,917,416 | 4/1990 | Westphal et al. | 292/DIG. 47 X |
| 5,087,087 | 2/1992 | Vetter | 292/48 |
| 5,118,145 | 6/1992 | Tucker | 292/158 |
| 5,248,174 | 9/1993 | Matz et al. | 292/338 |

*Primary Examiner*—Rodney M. Lindsey

[57] ABSTRACT

A ventilation stop for limiting the length of movement of a slidable door or window sash. The ventilation stop is located in a fixed element of a window or door assembly, preferably in an interior glazing stop of a fixed sash adjacent to the slidable sash. The stop includes a recess in the glazing stop, a tab disposed in and protruding from the recess, and a hinge pin disposed in friction fit through a bore in the tab and extending into the glazing stop beyond the recess, preferably in both directions from the tab. The axes of the bore and the pin are parallel to the direction of movement of the slidable sash, permitting the tab to be turned into an interfering relationship with the slidable sash, thereby limiting the length of movement of the sash, or to be turned out of interference, thereby permitting unrestricted movement of the sash. Preferably the glazing stop is hollow, allowing for easy insertion of the pin into the tab from within the glazing stop during assembly of a window or door unit. Preferably the pin is slightly crimped near its middle to increase the frictional fit of the pin within the tab. When the crimped pin is radially oriented and held within the bore such that the included crimp angle lies at 45° from the major plane of the tab, the pin acts as a leaf spring within the glazing stop, providing alternative preferred rest positions of the tab in either the open or closed position.

18 Claims, 8 Drawing Sheets

VENTILATION STOP FOR A SLIDING WINDOW OR DOOR

The present invention relates to stops for limiting the stroke of a sliding element, and particularly to stops for limiting the movement of a sliding window or door past a fixed point. The invention is especially suitable for use in fixing the degree of opening of a sliding window or door to permit ventilation while preventing ingress of an intruder, for example, a burglar.

By "sliding window" is meant an apparatus installed, or for installation, in a wall in which an aperture is closed or opened by an element, usually comprising a pane of glass, which slides either vertically or horizontally. By "sliding door" is meant a large, horizontally-sliding window intended for ingress or egress of persons through a wall. A sliding door may be glazed or non-glazed and may also serve to close, for example, a cupboard or closet.

Sliding windows and doors function by permitting a sash to slide in or on tracks in a frame. Such windows may be "double-hung," meaning that two moveable sashes are provided with two sets of tracks in a common frame and may slide vertically past each other. Windows may also be "single-hung," wherein a frame contains a moveable sash which slides vertically past a fixed sash. Mechanically equivalent windows in which the sashes move horizontally are known as "sliders," either single or double, respectively. Sliding doors are commonly provided as single sliders.

Sliding windows and doors typically are immobilized in the closed position, usually by some type of lock or latch between the sash and frame or between the two sashes. However, once the window is unlocked, or forced open, the sash can travel to its full opening. Since it is sometimes desirable to have a sliding window or door only partially open, as for ventilation, and to prevent its being opened further by someone on the outside, ventilation stops have been proposed.

U.S. Pat. No. 4,103,947 issued Aug. 1, 1978 to Delaney discloses "a ventilation stop mounted on a side rail of the upper sash of a double-hung window, capable of being swung into and out of the path of the upper horizontal rail of the lower sash to permit only limited relative opening movement of the upper and lower sashes." This stop is essentially an offset horizontal hinge, one hinge member being screwed onto the upper sash and the other provided with a protruding portion which interferes with passage of the sliding sash. The pintle is horizontal, and the protruding member can be swung out of the path of the slider when desired. Two problems with this apparatus are: first, that it is surface mounted on the upper sash and therefore is useable only on windows in which the side rails are thinner than, and offset from, the horizontal rails so that there is clearance between the sashes outboard of the glazing; and second, that the device as mounted on the side rail must be sufficiently far from the pane of the upper sash to permit the protruding member to swing out of the way. In many windows common today, one or both of these conditions does not pertain. An additional problem is that the apparatus obscures a significant portion of the viewing area of the fixed window at all times.

U.S. Pat. No. 4,758,033 issued Jul. 19, 1988 to Wolf discloses a ventilation stop comprising a vertical rod attached to the upper horizontal rail of an upper sash and an adjustable stop which rides on the vertical rod and can be secured at any desired position to limit the upward movement of the lower sash. This apparatus is clumsy and unsightly, it also obscures the window significantly, and at the full upward extent of travel of the lower sash the rod projects objectionably into the window opening.

Accordingly, it is a principal object of the invention to provide an improved ventilation stop for a sliding door or window which is useful on sliders having no clearance between the sashes outboard of the glazing.

It is a further object of the invention to provide an improved ventilation stop for a sliding window which requires a clearance equal to only about the thickness of the stop itself between the sliding rail and the fixed glazing.

It is a still further object of the invention to provide an improved ventilation stop for a sliding window which can be manufactured and installed very inexpensively.

It is a still further object of the invention to provide an improved ventilation stop for a sliding window having a plastic frame which utilizes the hollow plastic glazing elements of the frame.

It is a still further object of the invention to provide an improved ventilation stop for a sliding window which is visually unobtrusive and does not appreciably obstruct the view through the window sash or window opening.

Briefly described, a ventilation stop embodying the invention has a hinged planar tab mounted in a recess on the interior side of a fixed sash or window frame. The pintle of the hinge is parallel to the direction of movement of the slider. The tab protrudes from the recess and can be moved between "stop" and "open" positions. In stop position, the plane of the tab is perpendicular to the plane of the window, and the tab protrudes into the path of the slider and prevents further travel of the slider. In open position, which is substantially 90° from stop position, the plane of the tab is parallel to the plane of the window, and the tab does not interfere with slider travel.

In a preferred embodiment, the tab is mounted in a recess which is moulded or cut into a glazing stop of a fixed sash adjacent to the slidable sash. The tab has a bore through it parallel to the direction of travel of the slider. A pintle, or hinge pin, longer than the bore is disposed in the bore, which preferably is chamfered at an opening to facilitate entry of the pin. The pin extends beyond the tab and the bounds of the recess, preferably in both directions, into or behind the glazing stop, thereby securing the tab in the recess. Preferably the tab is about 0.625 inches long, 0.25 inches thick, and 0.625 inches high; and the pin is about 6.0 inches long and about 0.125 inches in diameter. When the sliding sash encounters the tab in the stop position, the tab is forced against the distal side of the recess, preventing further travel of the sliding sash. Preferably the pin extends within the glazing stop substantially beyond the engaging edge of the sliding sash, preventing the pin from being ripped out of the glazing stop by further opening pressure on the sliding sash.

In a preferred embodiment, the pin is bent or crimped to a slight angle near its midpoint, as by swaging. This increases slightly the effective diameter of the pin at that point, causing the pin to be retained within the tab by friction alone and to turn with the tab. When inserted into the tab during assembly, the pin is oriented so the included angle of the bend in the pin lies substantially at 45° to plane of the tab and the ends of the pin point toward the tab. This orientation provides a spring action in the pin which serves to hold the tab securely in the recess. The side of the tab facing the recess is forced against the back wall of the recess so that the tab can snap between the open and stop positions.

In a preferred embodiment, the tab is disposed in a hollow plastic glazing stop of, for example, a vinyl-frame window. The pin is easily inserted into the tab within the glazing stop from an end of the stop during assembly of the window.

Ventilation stops in accordance with the invention can be fitted to glazing stops made from wood, metal, or plastic. When the glazing stop is not hollow, bores for the pin must be drilled into the walls of the recess. In general, somewhat shorter pins must be used, preferably spring-pins which can be pressed into the bore in the tab and then compressed for insertion into the bores in the glazing stop. In these embodiments, it may not be convenient to provide a bend in the pin and so the device may lack the positive tab positioning characteristic of the preferred embodiment.

Tabs for ventilation stops can be made from a variety of durable, resistant materials, preferably metals such as steel or aluminum, or plastics such as glass-filled polycarbonate or PVC. Plastic tabs can be provided in colors to match the window frame if desired. Pins can be made from metal such as steel, preferably galvanized steel in applications where condensation is expected, or brass.

Preferably, ventilation stops in accordance with the invention are installed to permit the sliding sash or door to open about four inches. This opening is insufficient for an intruder to be able to reach through the opening and disable the ventilation stop.

The foregoing and other objects, features, and advantages of the invention, as well as presently preferred embodiments thereof, will become more apparent from a reading of the following description in connection with the accompanying drawings in which.

Figure 1:
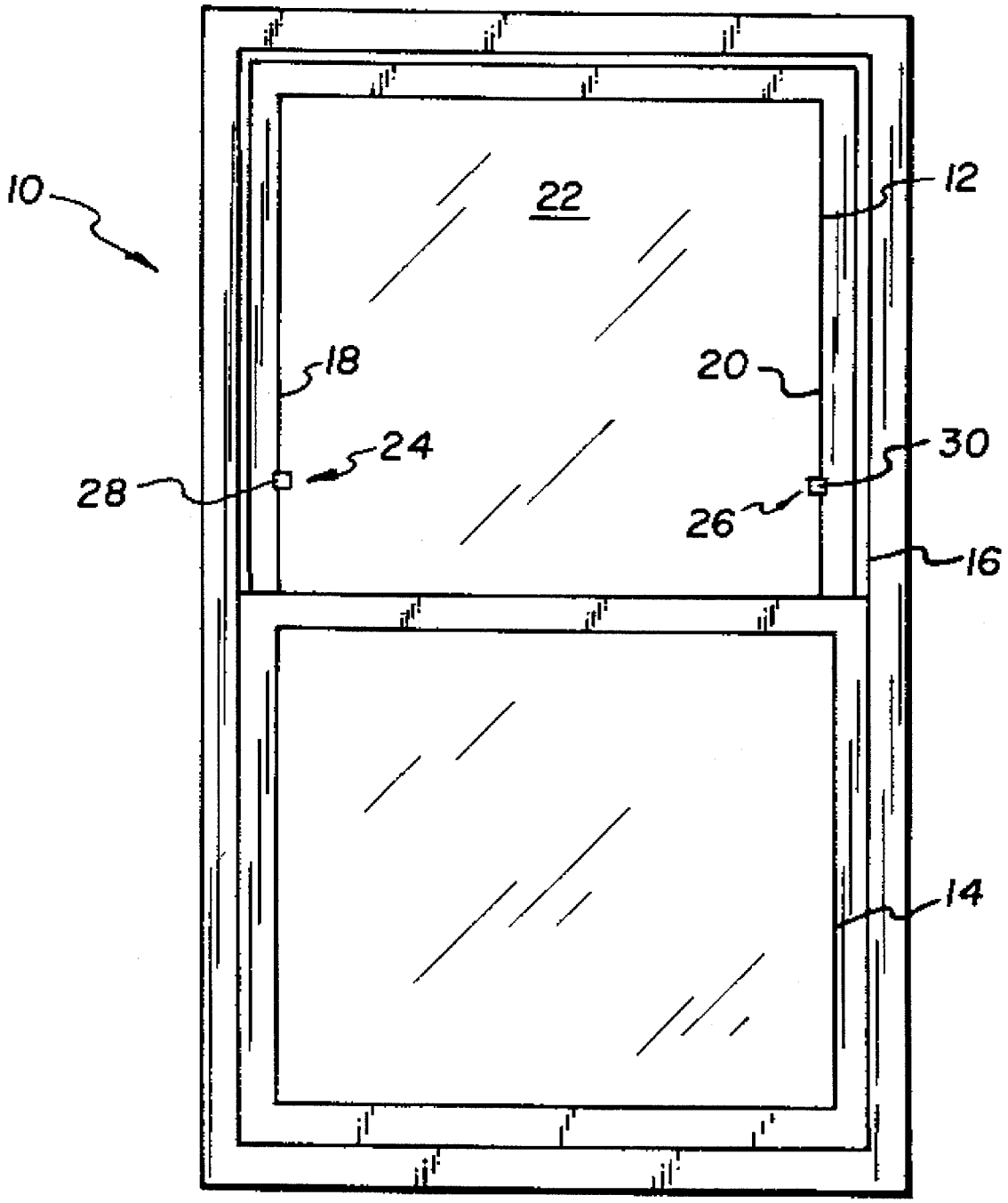
FIG. 1 is an elevational view of the interior side of a single- or double-hung sliding window having two ventilation stops in accordance with the invention.
Figure 2:
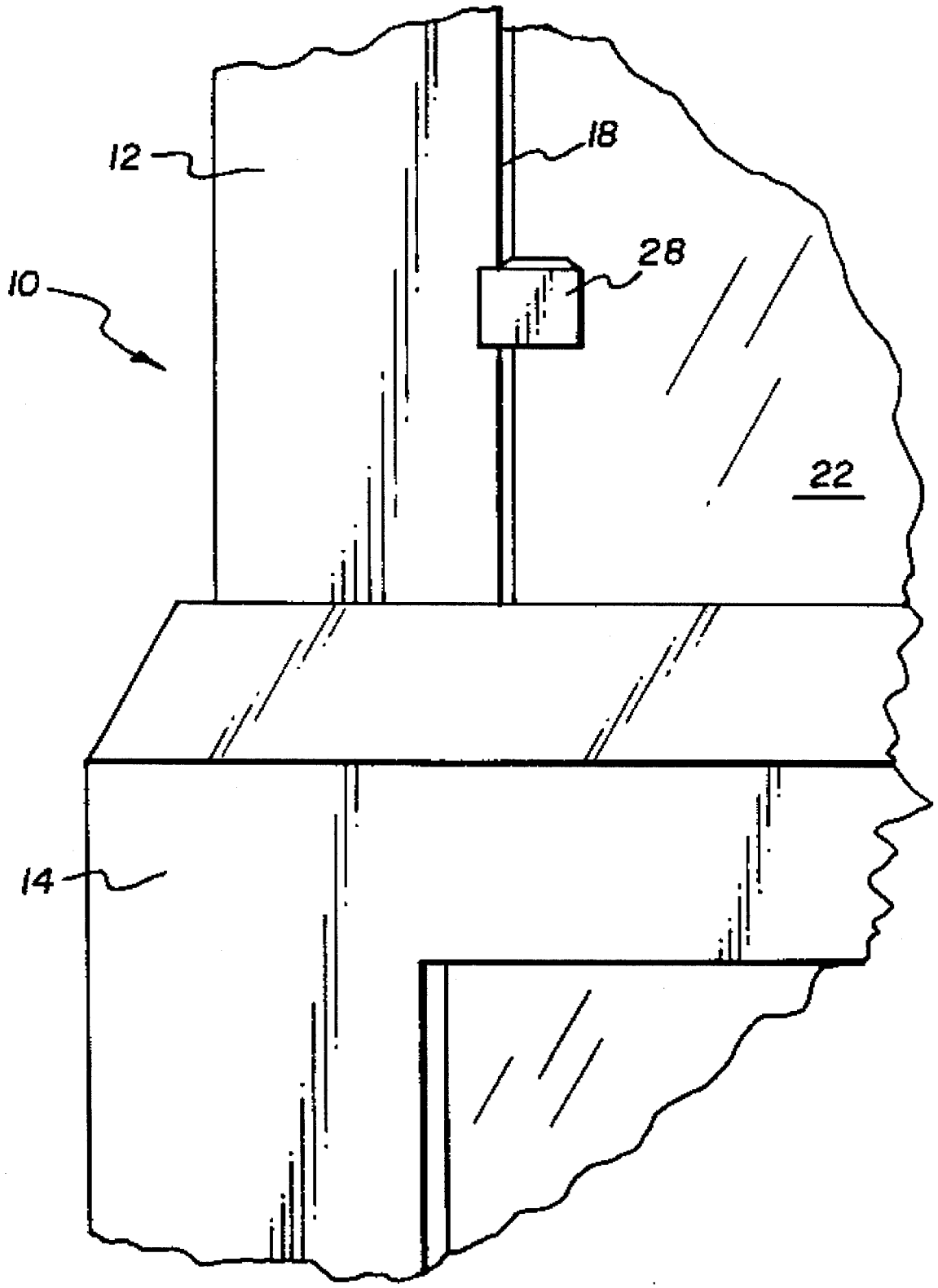
FIG. 2 is a perspective view of a portion of the window of FIG. 1, showing a ventilation stop in the open position.

Referring to FIG. 1, there is shown a window 10 having an upper sash 12 and a lower sash 14 in a frame 16. Sash 14 is disposed in a track in frame 16 which permits it to slide past sash 12 as desired. Sash 12 can also be disposed in a track for sliding movement or it can be fixed. Sash 12 has left and right glazing stops 18 and 20, respectively, which are attached to sash 12 and serve to retain the glass 22 in frame 12. Glazing stops 18 and 20 are fitted with ventilation stops 24 and 26, respectively, in accordance with the invention as described hereinbelow. Stops 24 and 26 are shown in FIG. 1 in the open position in which they do not block the passage of sash 14 past sash 12. Tabs 28 and 30, of stops 24 and 26, respectively, lie substantially flat against the glass 22 in the open position, as shown for left tab 28 in more detail in FIG. 2.

Figure 3:
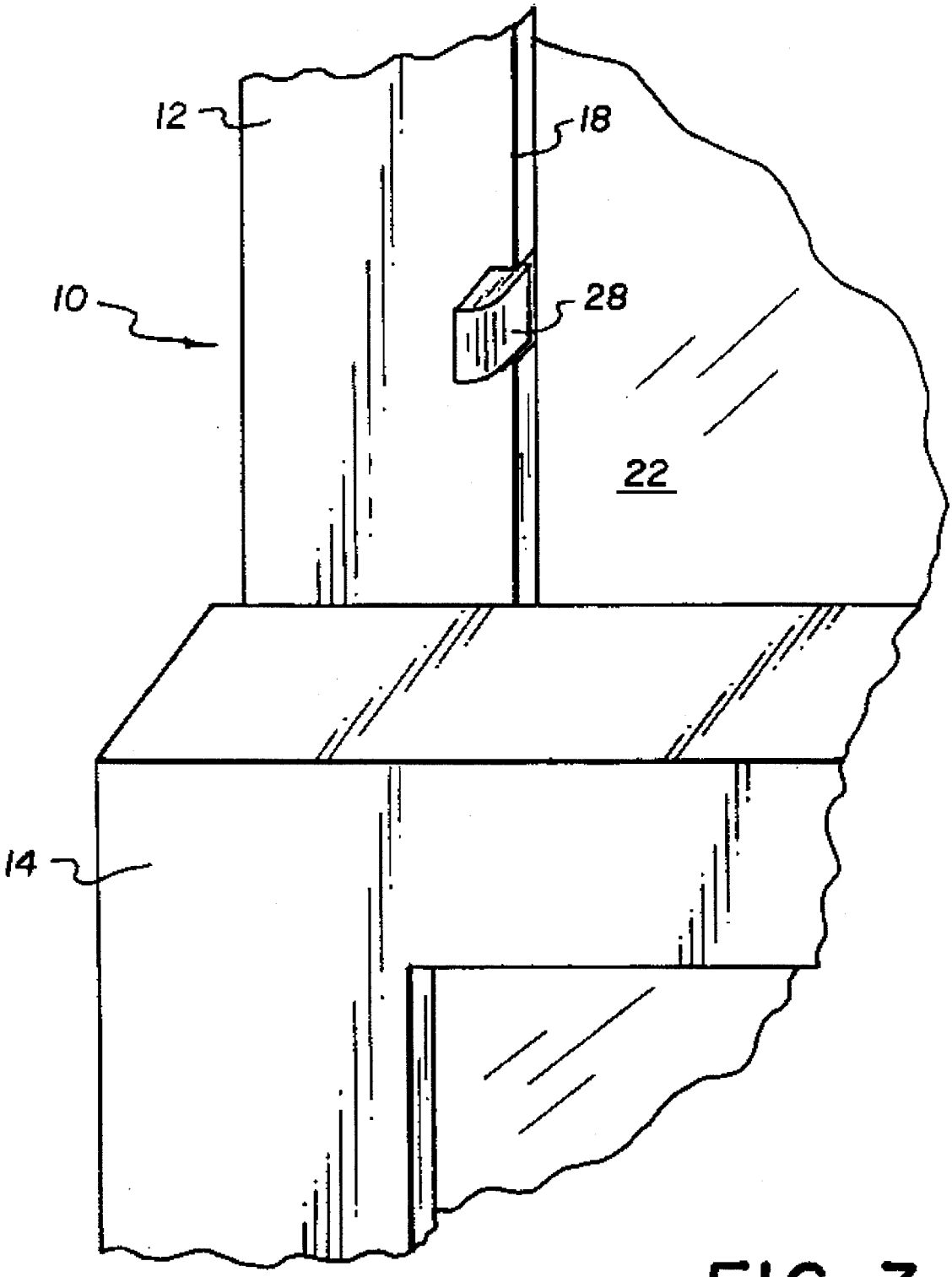
FIG. 3 is a view like that of FIG. 2, showing a ventilation stop in the closed or stopping position.
Figure 4:
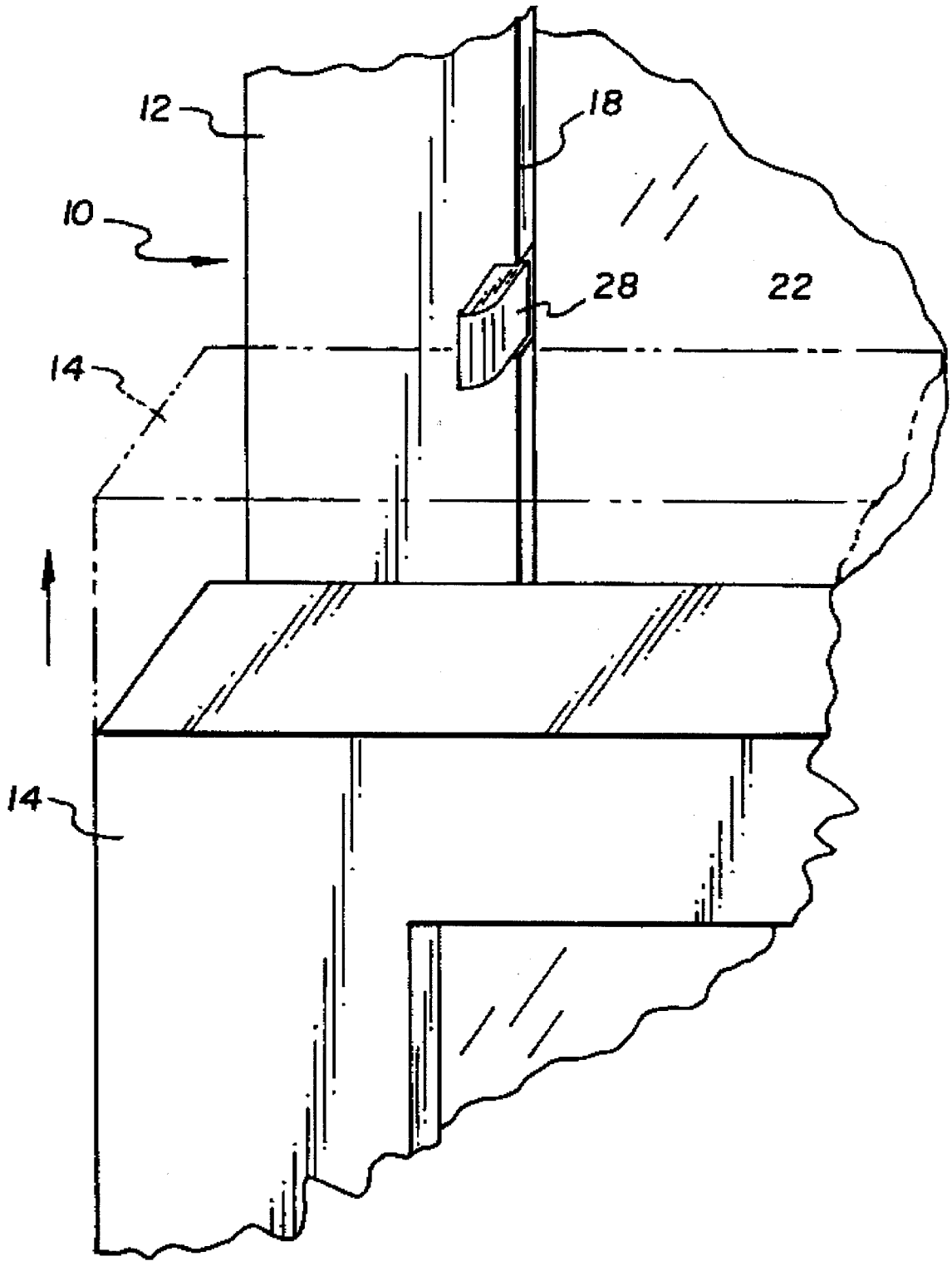
FIG. 4 shows movement of the sliding sash of FIG. 3 to a stopped position against the ventilation stop.

Tab 28 can be turned about a vertical axis through an angle of substantially 90° from its open position, whereby it assumes a blocking or closed position in the path of movement of sash 14 past sash 12, as shown in FIG.3. FIG. 4 shows the limit of travel of sash 14. Although passage is blocked by use of a single ventilation stop, it is preferable to use two such stops as shown in FIG. 1 to avoid cocking of the sash in the frame and possible damage to the window unit.

Figure 5:
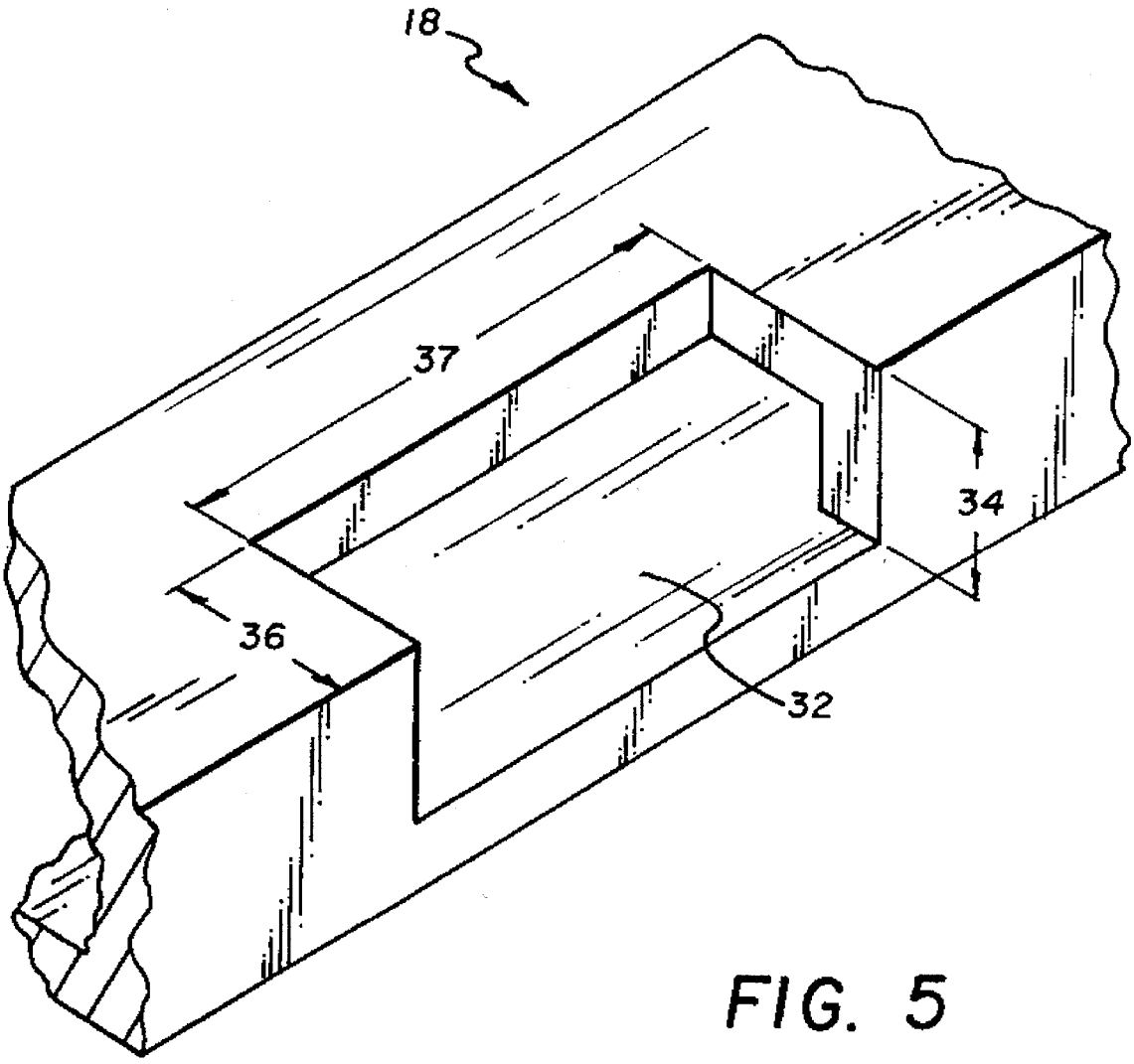
FIG. 5 is an enlarged isometric view of a section of hollow glazing stop, showing a recess formed to receive a stop tab and pin.

Construction and assembly of a preferred embodiment of a ventilation stop in accordance with the invention is relatively simple. A recess 32 is provided in a glazing stop such as 18, as shown in FIG. 5. In a wood frame window, recess 32 can be routed from the surface of glazing stop 18, or the glass can be removed from the frame and the recess routed from the glazing channel. The invention is better suited to windows having glazing stops which are formed from hollow tubing, such as plastic or metal sash windows. Recess 32 then is easily cut from the outside of the tubing.

Figure 6:
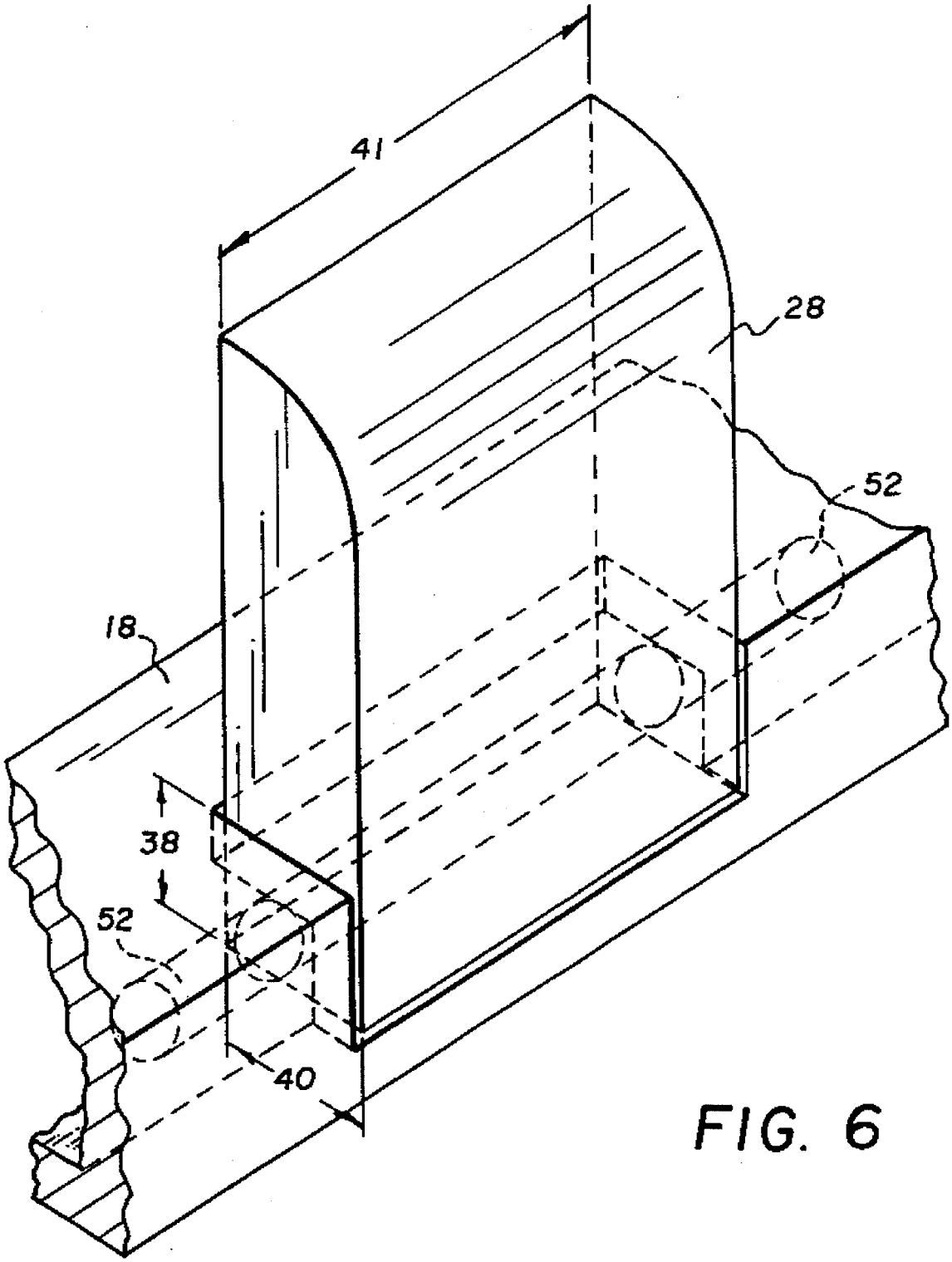
FIG. 6 shows the recess of FIG. 5 with a stop tab and crimped pin installed.

Recess 32 should be cut with precision to only a few thousandths of an inch greater in depth 34, width 36, and height 37 than the corresponding dimensions 38, 40, and 41, respectively, of tab 28, as shown in FIG. 6. This assures a snug fit of the tab in the recess. It also assures positive seating of the tab in the open and closed positions. In the open tab position, first tab surface 42 rests against first recess surface 44, and second tab surface 46 rests against second recess surface 48. In the closed tab position, third tab surface 50 rests against second recess surface 48, and second tab surface 46 rests against first recess surface 44.

Figure 8:
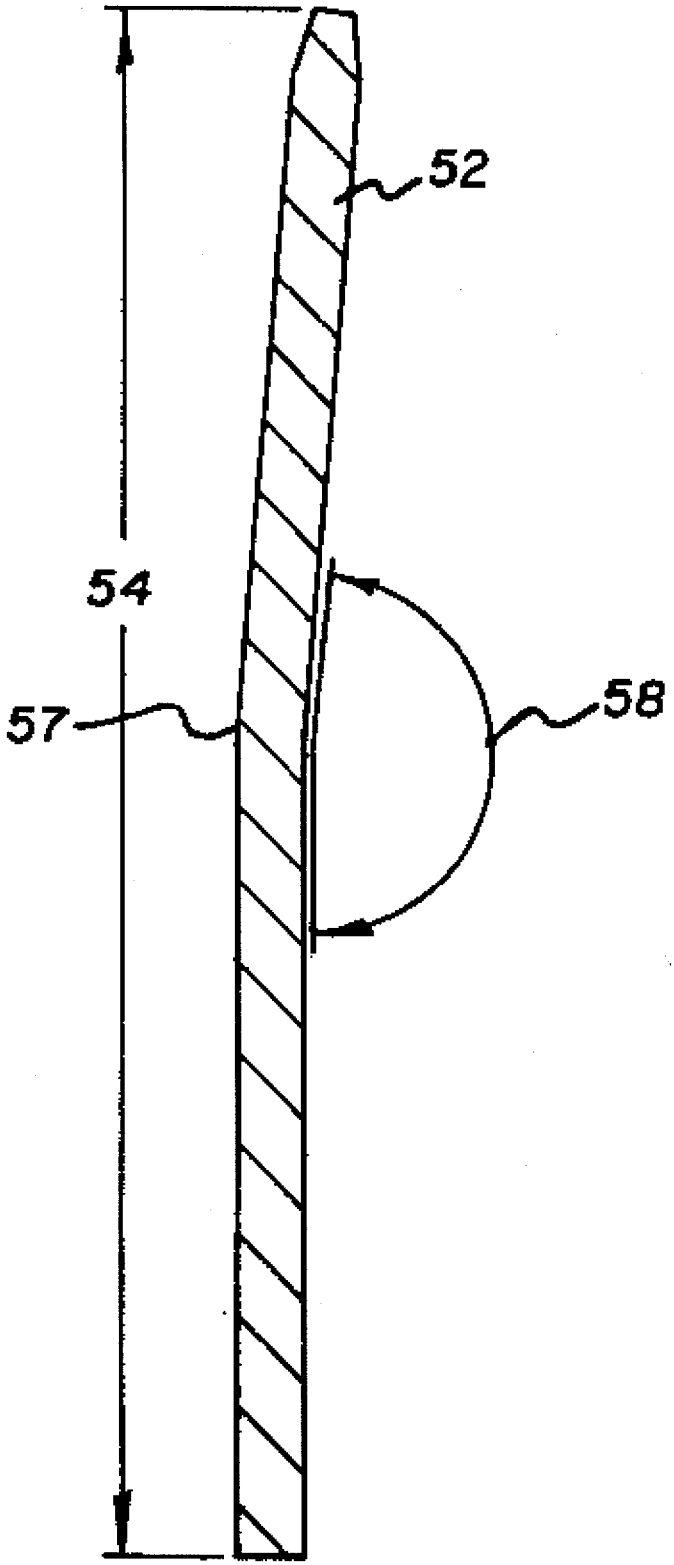
FIG. 8 is a cross-sectional view of a crimped pin in accordance with the invention.

Tab 28 is held in recess 32 by means of a pin 52 which is substantially longer than height 41. In a preferred embodiment, tab height 41 is about 0.625 inches and pin length 54 is about 6.0 inches. Pin 52 is disposed in a bore 56 in tab 28 with approximately equal lengths of pin extending beyond each end of the bore. The bore 56 can be sized such that the pin is held in an interference fit or, preferably, pin 52 is slightly bent or crimped in the middle 57 as shown in FIG. 8 through an angle 58 of, for example, between 1 and 5 degrees.

Figure 7:
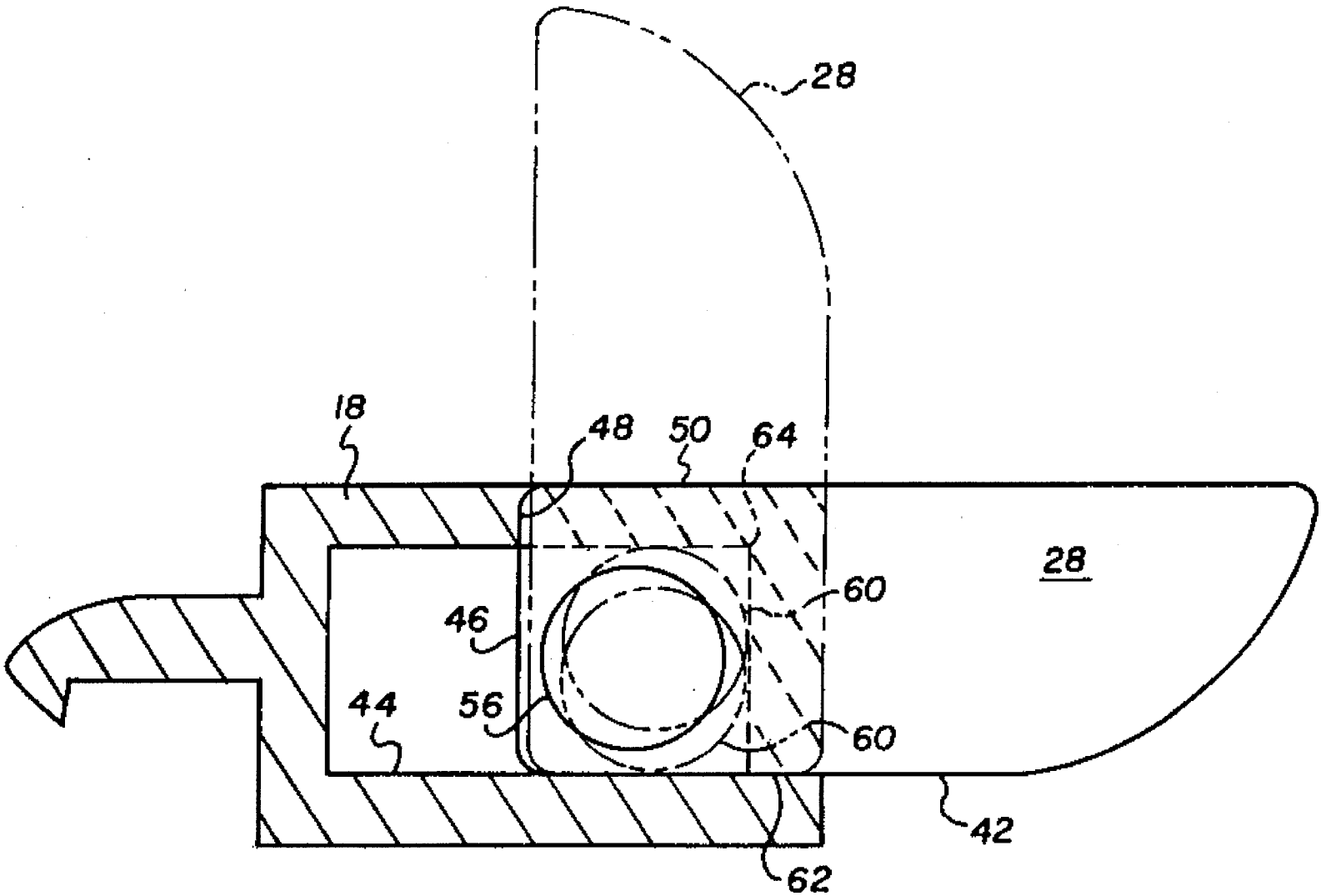
FIG. 7 is a cross-sectional view taken along line 7—7 in FIG. 6.

Crimping the pin provides two benefits. First, it increases slightly the maximum transverse dimension of the pin at the point of the crimp which serves to fix the pin securely in the tab and enables the pin to rotate with the tab between the open and closed positions. Second, when installed in the tab in a proper orientation, it acts as a leaf spring to hold the tab snugly in the recess and to provide positive seating of the tab in the two positions. The proper orientation has the included angle 58 facing generally the longer portion of the tab and at 45° to the plane of the tab. This allows the ends 60 of the pin to seek a first internal corner 62 of hollow stop 18 in the open position, and a second internal corner 64 in the closed position, as shown in FIG. 7.

From the foregoing description it will be apparent that there has been provided an improved ventilation stop, wherein the opening of a sliding window or door can be limited to a predetermined length. Variations and modifications of the herein described ventilation stop, in accordance with the invention, will undoubtedly suggest themselves to those skilled in this art. Accordingly, the foregoing description should be taken as illustrative and not in a limiting sense.

What is claimed is:

1. A stop for governing the path of movement of a movable first element, comprising:

a) a second element in proximity to said first element, which second element can be motionless while said first element is moved past said second element, said second element having a recess in proximity to said path of said movement;

b) a tab rotatably disposed in and protruding from said recess and having a bore therethrough in a direction parallel to said path of said movement of said first element, which tab is rotatable about said bore to a first position in said path of said movement of said movable first element and to a second position out of said path of said movement of said movable first element; and c) a hinge pin disposed in said bore and extending within said second element beyond said recess to retain said tab in said recess and to permit said tab to be rotated between said first and second positions, said hinge pin being crimped to form a leaf spring for biasing said tab to either of said first and second positions.

2. A stop in accordance with claim 1 wherein said first element is a window sash.

3. A stop in accordance with claim 1 wherein said first element is a door.

4. A stop in accordance with claim 1 wherein said second element is a sash.

5. A stop in accordance with claim 4 wherein said second sash is slidable.

6. A stop in accordance with claim 4 wherein said second sash is fixed.

7. A stop in accordance with claim 4 wherein said sash further comprises a glazing stop.

8. A stop in accordance with claim 7 wherein said glazing stop is hollow.

9. A stop in accordance with claim 7 wherein said glazing stop is formed of material selected from the group consisting of plastic, metal, and wood.

10. A stop in accordance with claim 1 wherein said bore has an axis which is parallel to the direction of said movement of said first element.

11. A stop in accordance with claim 1 wherein said tab is formed of material selected from the group consisting of plastic, glass-filled plastic, and metal.

12. A stop in accordance with claim 10 wherein said tab is turnable about said axis either to interfere or not interfere with the movement of said first element past said second element.

13. A stop in accordance with claim 1 wherein said hinge pin is retained in said bore by friction.

14. A stop in accordance with claim 1 wherein said hinge pin is formed of material selected from a list including brass, steel, and galvanized steel.

15. An assembly comprising:

a) a frame;

b) a plurality of sashes within said frame, at least a first one of which sashes is slidably movable;

c) a ventilation stop in a second of said plurality of sashes adjacent to said first sash, said stop governing the path of movement of said first sash past said second sash, said ventilation stop including i) a glazing stop in said second sash, said glazing stop having a recess in proximity to said path of said movement;

ii) a tab rotatably disposed in and protruding from said recess and having a bore therethrough in a direction parallel to said path of said movement of said first sash, which tab is rotatable about said bore to a first position in said path of said movement of said first sash and to a second position out of said path of said movement of said first sash; and iii) a hinge pin disposed in said bore and extending within said glazing stop beyond said recess to retain said tab in said recess and to permit said tab to be rotated between said first and second positions, said hinge pin being crimped to form a leaf spring for biasing said tab to either of said first and second positions.

16. An assembly in accordance with claim 15 wherein said first sash is a window.

17. An assembly in accordance with claim 15 wherein said first sash is a door.

18. An assembly in accordance with claim 15 further comprising a plurality of ventilation stops.

* * * * *